United States Patent [19]

Konrad

[11] Patent Number: 4,688,330

[45] **Date of Patent: * Aug. 25, 1987**

[54] GUIDE FOR ELLIPSE CONSTRUCTION

[76] Inventor: Joseph D. Konrad, 6340 Stumph Rd., Parma Heights, Ohio 44130

[ * ] Notice: The portion of the term of this patent subsequent to May 20, 2003 has been disclaimed.

[21] Appl. No.: 824,777

[22] Filed: Jan. 31, 1986

Related U.S. Application Data

[63] Continuation-in-part of Ser. No. 605,208, Apr. 30, 1984, Pat. No. 4,589,210, which is a continuation-in-part of Ser. No. 486,106, Apr. 18, 1983, abandoned, which is a continuation-in-part of Ser. No. 321,471, Nov. 16, 1981, abandoned.

[51] Int. Cl.[4] ..... B43L 13/20

[52] U.S. Cl. ..... 33/27.03; 33/565

[58] Field of Search ..... 33/565, 27.03, 27.01, 33/27.02, 27.12, 30.1, 30.2, 563, 566

[56] References Cited

U.S. PATENT DOCUMENTS

| | | | |
|---|---|---|---|
| D. 137,905 | 5/1944 | Kardux | 33/565 |
| D. 165,849 | 2/1952 | Jordan | 33/565 |
| 2,604,702 | 7/1952 | Collins | 33/565 |
| 3,568,327 | 3/1971 | Furuoka | 33/565 |
| 4,251,920 | 2/1981 | Cassagnes | 33/565 |
| 4,589,210 | 5/1986 | Konrad | 33/27.03 |

*Primary Examiner*—Charles Frankfort
*Assistant Examiner*—Patrick R. Scanlon
*Attorney, Agent, or Firm*—Robert B. Henn

[57] ABSTRACT

A template set for inscribing a plurality of ellipses with pencil, inking pen or other marking means is disclosed. The invention comprises a two-part unit for small ellipses, or a three-part unit for larger ellipses, enabling an individual ellipse or series or ellipses to be drawn, whether or not such ellipses have common foci or eccentricity. The device can further be used to draw ellipses of varying size and degrees of eccentricity, and having common foci. The device consists of an exterior holder, an interior holder, a large-ellipse guide portion and a small-ellipse guide portion. In the embodiment for drawing large ellipses, a shim is used to maintain the large-ellipse guide portion in spaced relationship from the drafting medium.

5 Claims, 9 Drawing Figures

GUIDE FOR ELLIPSE CONSTRUCTION

CROSS-REFERENCE TO RELATED APPLICATIONS

This application is a continuation-in-part of my copending application Ser. No. 605,208, filed Apr. 30, 1984, which was a continuation-in-part of my then copending application Ser. No. 486,106, filed Apr. 18, 1983, which was in turn a continuation-in-part of application Ser. No. 321,471, filed Nov. 16, 1981. The first-named application is now U.S. Pat. No. 4,589,210; the latter two applications are both now abandoned.

BACKGROUND OF THE INVENTION

1. Field of the Invention

The present invention is in the field of drafting templates and guides. More particularly, this invention presents means to enable a draftsman to draw a series of related ellipses with high precision and without damage to the drafting medium.

2. Description of the Prior Art

Generally speaking, anyone can generate an ellipse by placing pins in a drafting medium at the foci of the ellipse, and, using a pencil, draw any number of ellipses by maintaining the pencil within a taut loop of string passing around the pins. More reasonably, however, a template is used, both for ease and to avoid damage to the drafting medium, as well as to facilitate the productivity of the draftsman. At the same time, professional drawing-board experience is essential in using a guide for drawing related ellipses of increasing or decreasing size and varying eccentricity for inking in drawings. In drawing such families of ellipses, it is difficult even for the experienced professional draftsman to obtain, e.g., 0.8-millimeter (mm) accuracy in spacing between circles, especially when inking-in is required.

Currently, when a professional draftsman is confronted with the problem of drawing a series of related ellipses, he has his choice of using various templates of the existing art, all of which have drawbacks.

In using a template, each succeeding figure must be located appropriately by means of coordinating lines adjacent the hole in the template chosen for use; however, no matter how careful the draftsman is, he is never completely sure that each succeeding figure is precisely aligned. Further, the range of sizes available with current templates is somewhat restricted. In some cases, the lack of precision drawings can be critical, especially, as noted, where those drawings are used for shop and field work or in the presentation of patent illustrations. When the distance between adjacent figures approaches the thickness of the inked line, maintaining proper relationship with existing templates also becomes marginal.

Another problem encountered with the apparatus and methods of the prior art is that a required series of ellipses to be drawn must be carefully planned. Generally, the smallest ellipse is drawn first, followed by those of increasing size. An attempt to proceed in the opposite fashion is difficult because the template, even though substantially transparent, often at least partly obscures the larger ellipse in the attempt to align the smaller. In the event that the draftsman discovers that he has to draw a series of ellipses congruent with one already drawn because of a change in specifications or for other reasons, it is not uncommon to have to remove the earlier-drawn figures and begin over. In the case where the ellipse has already been inked, the job becomes very difficult, and potentially damaging to the drafting medium.

Irrespective of the planning required in drawing ellipses with existing templates, a further problem arises where the range of the sizes of ellipses to be drawn is fairly great. Current practice requires the use of several templates, with the problems of careful alignment as already noted; further to that, however, is the circumstance that different templates may have different kinds of reference marks, which then requires that the draftsman pay particular attention to how he is aligning the template in order to avoid imprecision in the drawing.

While none of the problems discussed here are insurmountable, they are time-consuming, and detract from the productivity of the draftsman.

Even if the foregoing problems can be avoided, the draftsman now faces the problem of inking the pencil drawing without smearing the lines. Using templates of the prior art, the draftsman has to be careful not to permit the pen to contact the line where the template rests on the paper, or the ink will spread into that line by capillary action, causing his line to be thicker than he wants, even assuming that he is able to control its actual placement with the necessary precision in the first place.

In present practice, when a draftsman makes an inked ellipse with a template, he places some kind of shim under the template to prevent its direct contact with the drawing medium to avoid capillarity. The use of the shim, however, invites both inaccuracy in the dimension of the ellipse and slippage of the template on the shim. To avoid the latter problem, the draftsman can tape the two together, but then tends to lose whatever time advantage he has gained by the use of the template.

Furuoka, in U.S. Pat. No. 3,568,327, shows what is essentially an amusement device for the production of epicyclic, hypocyclic and similar figures generated by the interrelation of a fixed reference point with another, moving point. By its very nature, the Furuoka device is incapable of producing related ellipses except by moving the template, a problem discussed hereinabove. The Furuoka apparatus further has means whereby the position of the template is fixed at specified angular intervals.

A device similar to that of Furuoka is described by Siegel in U.S. Pat. No. 3,699,660, differing from Furuoka in that it is adjustable to permit infinite variation among the designs generated. The Siegel device, however, is also limited in that it requires movement of the entire device to permit drawing of curvilinear figures related in size, but with a commonality of center or focus, thereby leading to the imprecision described hereinabove.

Jordan, in U.S. Pat. No. Des. 165,849, shows a drafting template whereby lines can be drawn at variable angles to an initial reference point or line. Use of the Jordan template requires the removal and replacement of screws to permit the template to be changed or the angle of a particular line altered.

None of the references discussed herein makes any provision for inking of a precision drawing, nor do they provide for the construction of a plurality of elliptical figures without regard to the order in which the figures are drawn.

SUMMARY OF THE INVENTION

The means of the present invention comprises the combination of an exterior holder, an interior holder, a large-ellipse guide portion and a small-ellipse guide portion into a template set for the construction of a plurality of elliptical figures; when large figures are drawn, a shim is used to maintain the proper distance of the large-ellipse guide portion from the paper. Preferred holder thickness is about 2.5 mm; the thickness of the guide portions and the shim is preferably about 1.2 mm, although greater or lesser thicknesses are within the spirit and scope of this invention. The exterior holder can be any shape; the preferred embodiment is square with round corners for ease and convenience of use. The ellipse-guide portions have a family of hole sizes and eccentricities, and are raised above the surface of the drafting medium by the thickness of the respective holder, and in the case of the large-ellipse guide portion, by the further use of a shim. Both the shim and the interior holder fit into a recess in the exterior holder. The size and shape of the interior conformation of each holder is complementary with the size and shape of the exterior perimeter of the respective ellipse-guide portion. The material used for this device is preferably a dimensionally stable, transparent and impact-resistant material such as, e.g., polystyrene, polyethylene, polyethylene terephthalate, polyvinyl chloride, polycarbonate and the like. Any or all of the portions of the tool may be colored for convenience.

The method of the present invention comprises establishing X- and Y-axis lines on the drafting medium where the ellipses are to be drawn, aligning inscribed axis referents of the exterior or interior holder thereon, emplacing the appropriate ellipse-guide portion, and drawing the desired figure. For drawing a figure of different size, the guide portion is then moved within the holder while the holder is maintained fixed with respect to the medium, and the next figure drawn. The process is repeated for the number of figures desired. Where there is a large range of figures to be drawn, the shim within the exterior holder is removed after drawing large ellipses, and is replaced with the interior holder, without loss of alignment of the unit; the exterior holder is then removed if necessary or desirable, and further figures drawn with the use of the small-ellipse guide portion.

DESCRIPTION OF THE PREFERRED EMBODIMENTS

Figure 1:
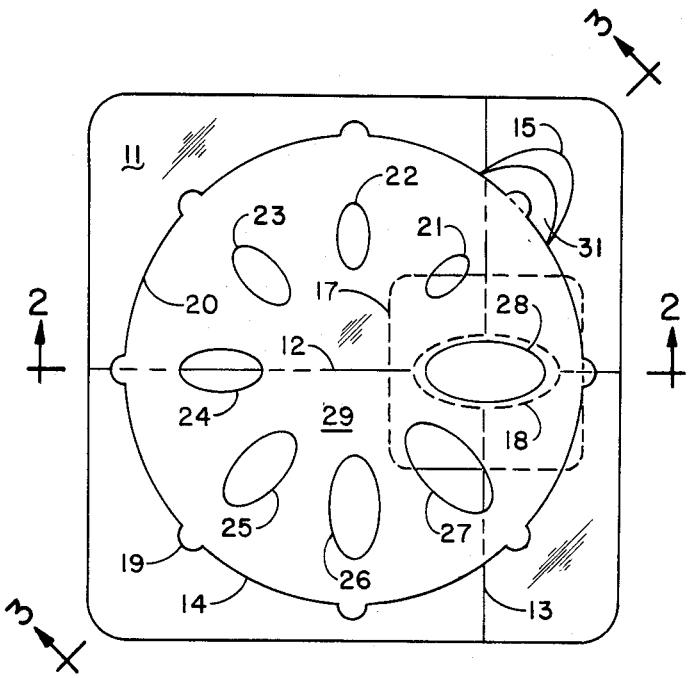
FIG. 1 is a plan view showing exterior holder and large-ellipse guide portion of the present invention.

The preferred embodiment of the present invention comprises a device for inscribing related elliptical figures in mechanical drafting by increasing or decreasing the required sizes by establishing an X or Y axis, or both, of the device to coincide with the X and Y axis on a pencil drawing. The device is a template set consisting of at least one holder and a ellipse-guide portion. For large ellipses, a large exterior holder provides location means for a smaller interior holder, which in turn permits the small-ellipse guide portion to be precisely located. The exterior of the ellipse-guide portion is complementary in size and shape with the interior of the respective holder. As used herein, the term "ellipse guide" is defined as a template means for inscribing ellipses. It is the unification in juxtaposition of a template device and an ellipse guide to form a unitary device accomplishing commonality or family relationship.

In the discussion herein, the eccentricity of an ellipse may be expressed as the angle in degrees at which the projection of a circle would produce the ellipse in question. Thus, if a given circle were viewed from an angle of 60°, it would appear to be an ellipse. Viewed from 30°, the same circle would appear as a flatter, or more eccentric, ellipse. The drawing figures herein depict a guide for drawing 30° ellipses; those skilled in the art will realize that the principles of the invention apply to an ellipse of any eccentricity, from a fractional degree to an eccentricity which is so great that the ellipse appears almost as a line, limited only by the thickness of the drafting instrument. While not shown in the drawings, each guide conveniently has the large diameter of the ellipse and its eccentricity marked thereon.

Referring now to FIG. 1, the exterior holder is indicated generally at 11, and is shown with a square shape, although the shape is not necessary to the function of this invention. Inscribed axial lines 12 and 13 permit alignment of the device with coordinate lines on the drawing. Large-ellipse guide portion 29 has an exterior shape 20 complementary to the interior conformation 14 of holder 11, and has holes 21 through 28 of prescribed size, chosen to permit ease and flexibility of drawing. Such sizes include, e.g., about ½ inch (in.) through about 2 in. by appropriately chosen steps, or about 12 millimeters (mm) through about 51 mm in integral steps, although smaller and larger sizes are within the spirit and scope of this invention, the limit here being only the size constraints imposed by the size of exterior holder 11 and large-ellipse guide portion 29. In the body of exterior holder 11 is an access notch 15 and relief 31 to permit ready removal and replacement of large-ellipse guide portion 29 by means of tab 31, as discussed more fully hereinbelow.

Figure 6:
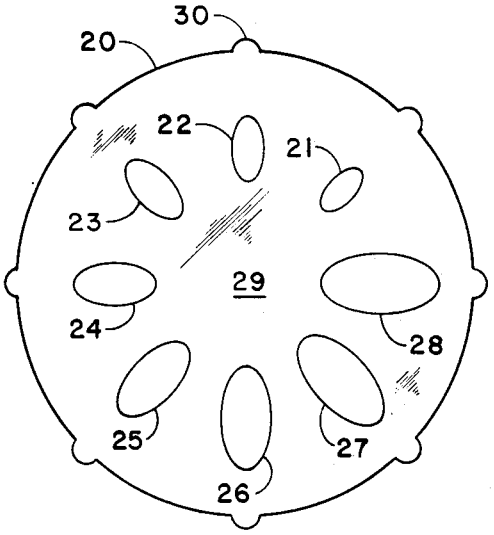
FIG. 6 shows the large-ellipse guide portion of the invention.

The interior conformation 14 of exterior holder 11 delineates the space into which large-ellipse guide portion 29 fits; the positioning of holes 21 through 28 is maintained with precise alignment in relation to lines 12 and 13 by the fit of projections 30 on guide portion 29, shown in FIG. 6, with recesses 19 on exterior holder 11. The specific size and shape of the alignment means is not critical, so long as their interrelationship retains the necessary alignment of the ellipse guide with the holder.

Figure 3:
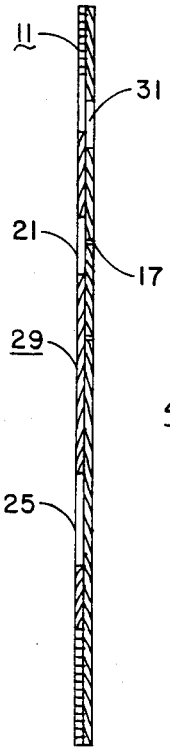
FIG. 3 is a view in section taken along lines 3—3 of FIG. 1.
Figure 4:
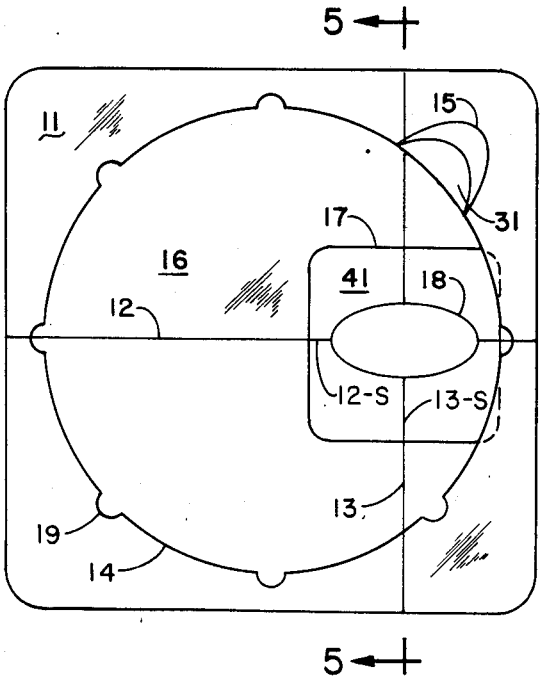
FIG. 4 is a plan view of the exterior holder with the shim therein.
Figure 7:
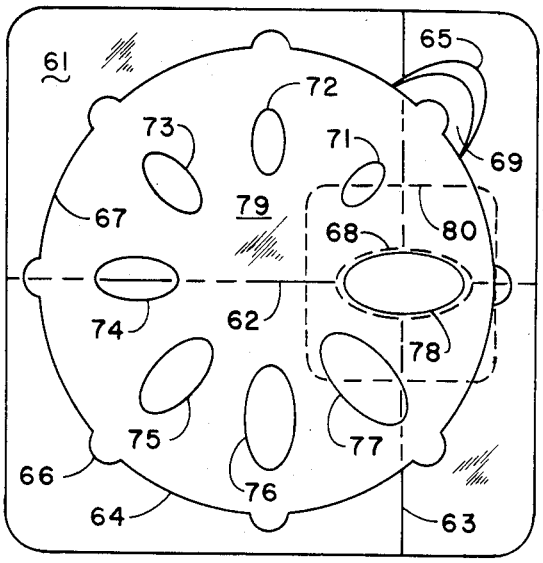
FIG. 7 is a plan view of the interior holder with the small-ellipse guide emplaced therein.

Shim 41, shown in FIG. 4, has a shape as defined by, and juxtaposed within, recess 17, and is discussed more fully with respect to FIGS. 3, 4 and 7. Referring back to FIG. 1, hole 28 in large-ellipse guide portion 29 is juxtaposed over hole 18 in shim 41.

Figure 2:
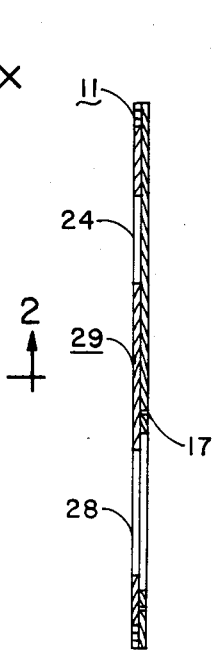
FIG. 2 is a view in section taken along lines 2—2 of FIG. 1.

FIG. 2 is a sectional view taken along lines 2—2 of FIG. 1. The section is taken through hole 18 in shim 41, and holes 24 and 28 large-ellipse guide portion 29. As shown in FIGS. 1 and 2, hole 28 is juxtaposed over hole 18. Hole 18 is larger than any of the holes 21 through 28 of large ellipse guide portion 29; therefore, shim 41 acts as a spacer to prevent large-ellipse guide portion 29 from physically touching the surface of the drafting medium, and prevents capillarity from spreading the ink when a line is drawn with a pen.

FIG. 3 is a view in section taken along lines 3—3 of FIG. 1. The section is taken through access notch 15 and hole 25 in large-ellipse guide portion 29, and shows shim 41, the size and shape of which is defined by recess 17, juxtaposed in exterior holder 11.

FIG. 4 shows a plan view of exterior holder 11 with shim 41 in place, large-ellipse guide portion 29 having been removed from the view shown in FIG. 1. Axial lines 12*s* and 13*s* on shim 41 are extensions of and colinear with lines 12 and 13 on exterior holder 11.

Figure 5:
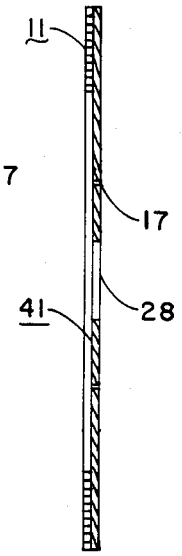
FIG. 5 is a sectional view taken along lines 5—5 of FIG. 4.

FIG. 5, a sectional view taken along lines 5—5 of FIG. 4, shows exterior holder 11 with shim 41 in place in recess 17. Hole 18 is shown in shim 41.

FIG. 6 shows large-ellipse guide portion 29 removed from the assembled invention as shown in FIG. 1. Circumferential line 20 is complementary with interior conformation 14 of exterior holder 11. As noted previously, alignment tabs 30, in cooperation with alignment recesses 19 in exterior holder 11, cause ellipses 21 through 29 each to be aligned with respect to exterior holder 11. By using ellipses 21 through 29 to draw ellipses, each such ellipse is maintained in a congruent relationship with any other ellipse drawn when exterior holder 11 is maintained in its original position. Exterior holder 11 is conveniently maintained in position by, e.g., taping to the drafting medium or weighing or clamping down.

FIG. 7 is a plan view of interior holder 61, with small-ellipse guide portion 79 in place. Access notch 65 and relief 69 serve the same function for small-ellipse guide portion 79 as do access notch 15 and relief 31 for large-ellipse guide portion 29. Holes 71 through 78 in small-ellipse guide portion 79 permit congruent ellipses from about 1/16 in. or about 1 mm up to about ½ in. or about 12 mm to be drawn, in a fashion similar to that as described with respect to exterior holder 11 and large-ellipse guide portion 29.

Figure 8:
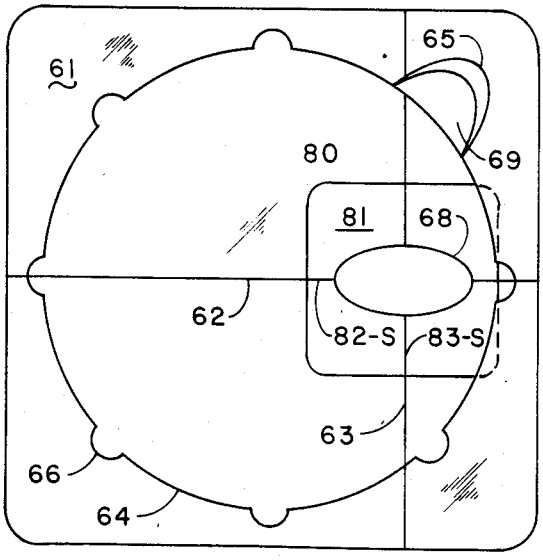
FIG. 8 shows the interior holder.
Figure 9:
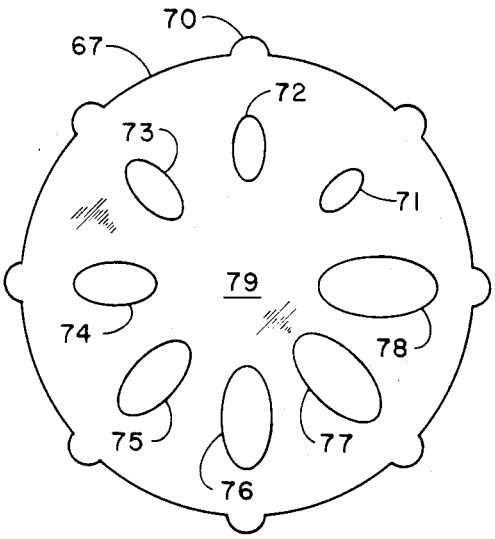
FIG. 9 shows the small-ellipse guide portion.

FIG. 8 is a plan view of interior holder 61, small-ellipse guide portion 79 having been removed from the view shown in FIG. 7. Interior conformation 64 of interior holder 61 is conveniently a circle, and is identical in size and shape with the exterior circumference 67 of guide portion 79. Recesses 66 permit precise alignment of small-ellipse guide portion 79, shown in FIG. 9, by the juxtaposition of tabs 70. Those skilled in the art will understand that any means for insuring alignment of guide portion 79 is within the spirit and scope of this invention. Such means include, without limitation, the recesses 19 and projections 30 of the large-ellipse guide shown in FIGS. 1 and 6.

Referring again to FIG. 8, axial lines 62 and 63 serve the same functions as do lines 12, 13, 12*s* and 13*s* of exterior holder 11, shim 41 and large-ellipse guide portion 29. Hole 68 provides access for the drafting instrument to the medium, in the same fashion as hole 18 in shim 41. Small shim 81 can be made removable if desired; small shim 81 has axial lines 82*s* and 83*s* inscribed on it for alignment. Lines 82*s* and 83*s* are colinear with lines 62 and 63.

Interior holder 61 is identical in size and shape with shim 41, fitting snugly enough in exterior holder 11 to prevent movement of the exterior and interior holders with respect to each other, but loosely enough to permit ready insertion or removal of interior holder 61 into or from exterior holder 11.

In the utility of this invention, a drawing is made on a suitable medium which will properly receive pencil or ink. Horizontal and vertical axis lines X and Y are first conveniently drawn in pencil to provide a reference point at their intersection. If large ellipses are to be drawn, exterior holder 11 is placed over the area with hole 18 in shim 41 juxtaposed by means of axial lines 12 and 13 and 12*s* and 13*s* over the intersection of the lines drawn on the drafting medium. Large-ellipse guide portion 29 is aligned by the spatial relationship of recesses 19 and tabs 30, and the desired ellipses drawn. A given ellipse having been drawn, large-ellipse guide portion 29 is removed by inserting, e.g., a fingernail or pencil point under tab 31 juxtaposed in access notch 15, the guide portion 29 moved to present the next desired size, and the succeeding ellipse drawn. The process is repeated as desired.

For both the large-ellipse guide portion 29 and the small-ellipse guide portion 79, the alignment moiety of its respective holder, comprising recesses 19 and 66 in cooperation with tabs 30 and 70 respectively, permits the guide portion to be removed, rotated, inserted, restored to the original position, or any such operation, all without loss of alignment of the drawn figures one from another. The foregoing presumes that the holder 11 or 61 is maintained in place when the ellipse guide is moved.

In the event that small ellipses are required, shim 41 is removed, and interior holder 61 placed at the same position. Small-ellipse guide portion 79 is then placed in interior holder 61. If desired, exterior holder 11 can now be removed. With the appropriate hole of small-ellipse guide portion 79 juxtaposed over the ellipse to be drawn, and the appropriate recess 66 in place in recess 70, precision alignment of the smaller ellipses is assured, down to the limit imposed by the thickness of the drafting tool.

Those skilled in the art will realize that it is immaterial whether a small or a large ellipse is the first in a family drawn with the method and means of the present invention. As already noted, interior holder 61 can be placed within exterior holder 11 to provide a referent for small ellipses. If the smaller ellipses have been drawn first, exterior holder 11 is placed over interior holder 61, holder 61 removed, and shim 41 substituted. Large-ellipse guide portion 29 is then used to make larger ellipses as desired.

If it is necessary to erase any ellipse, whether it is to be redrawn as originally done, or substituted with another figure, the guide can be used as an eraser shield, or the figure simply erased and replaced with another figure. To facilitate erasure, shim 41 or 81 can be removed without loss of alignment of the instrument for redrafting of the original or a substitute figure. In any event, the invention provides the draftsman with a tool which significantly improves his productivity while at the same time saving undue wear on the drafting medium.

Another use of the guide means of the present invention is that of drawing shadow or relief lines on ellipses. Once the desired ellipse is drawn, the skilled draftsman can use the next larger hole to permit him to draw a shadow line, by judicious angling of the pen or pencil. For even the less-experienced person, the guide can be used by shifting it slightly to permit the same ellipse to be used to draw the shadow line.

Those skilled in the art will realize that for each ellipse to be drawn, there is a unique guide hole. Accuracy and alignment are assured each time there is a change in either size or eccentricity with or without a change in the other property, due to the fixed relationship of outer portion 11 with the drafting medium.

Another use of the ellipse guide is to prepare a series of views of a circle at progressively smaller viewing angles. By using the circle guide described in my U.S. Pat. No. 4,589,210, a circle can be drawn, followed by a series of ellipses whose large diameter is the same as the diameter of the original circle, the subsequent ellipses then displaying varying degrees of eccentricity, by the use of appropriate ellipse-guide templates of the present invention.

Modifications, changes and improvements to the preferred shape and forms of the invention herein disclosed, described and illustrated may occur to those skilled in the art who come to understand the principles and precepts thereof. Accordingly, the scope of the patent to be issued hereon should not be limited to the particular embodiments of the invention set forth herein, but rather should be limited only to the advance by which the invention has promoted the art.

I claim:

1. A template set for constructing ellipses consisting of an exterior holder with a cavity defining an interior conformation and a recess extending through the holder; a large-ellipse guide portion adapted to fit into said cavity of said exterior holder and a shim with an exterior perimeter adapted to fit into said recess, said large-ellipse guide portion being complementary in size and shape with said interior conformation of said exterior holder and including a plurality of elliptical cutouts, the exterior perimeter of said shim being complementary in size and shape with said recess of said exterior holder; said shim including at least one opening, whereby, when one of said elliptical cutouts of said large-ellipse guide portion is aligned with said opening of said shim, a user can construct an ellipse.

2. The template set of claim 1 having further an interior holder with an exterior size and shape and a cavity defining an interior conformation, said interior holder being adapted to fit into said recess; a small-ellipse guide portion being adapted to fit into said cavity of said interior holder and having a plurality of elliptical cutouts and an exterior perimeter, the exterior size and shape of said interior holder being identical with said shim and with said recess of said exterior holder, and the exterior perimeter of said small-ellipse guide portion being complementary with said interior conformation of said interior holder; said interior holder including an aperture extending therethrough, whereby, when one of said elliptical cutouts of said small-ellipse guide portion is aligned with said aperture of said interior holder, a user can construct an ellipse.

3. The template set of claim 1 wherein said template set is made of a transparent, dimensionally stable, impact-resistant material.

4. The template set of claim 2 wherein said large and small ellipse guide portions have elliptical holes therein.

5. The template set of claim 2 wherein said exterior and interior holders and said large and small ellipse guide portions have alignment means thereon.

* * * * *